US006401501B1

(12) United States Patent
Kajuch et al.

(10) Patent No.: US 6,401,501 B1
(45) Date of Patent: Jun. 11, 2002

(54) LOCK CONSTRUCTION

(75) Inventors: Peter Kajuch, Brookfield; Andrew Tischendorf, Campbellsport, both of WI (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 09/562,470

(22) Filed: May 1, 2000

(51) Int. Cl.[7] ..... E05B 37/06

(52) U.S. Cl. ..... 70/25; 63/38; 63/278.3; 640/825.31; 640/542; 395/114

(58) Field of Search ..... 70/25, 38, 63, 70/38 A, 278, 303 A, 278.1, 277, 278.3, 278.7; 340/542, 825.31, 825.32; 235/382; 400/76, 61; 395/114

(56) References Cited

U.S. PATENT DOCUMENTS

| | | | | | |
|---|---|---|---|---|---|
| 2,691,288 | A | | 10/1954 | Childs | 70/38 |
| 4,220,022 | A | | 9/1980 | Willach | 70/278 |
| 4,808,993 | A | * | 2/1989 | Clark | 340/825.31 |
| 4,851,652 | A | * | 7/1989 | Imran | 235/382 |
| 4,912,460 | A | | 3/1990 | Chu | 340/825.31 |
| 4,929,880 | A | * | 5/1990 | Henderson et al. | 320/30 |
| 4,988,987 | A | * | 1/1991 | Barrett et al. | 340/825.31 |
| 5,090,222 | A | | 2/1992 | Imran | 70/63 |
| 5,170,431 | A | | 12/1992 | Dawson et al. | 380/23 |
| 5,404,735 | A | | 4/1995 | Hsieh | 70/38 A |
| 5,451,934 | A | | 9/1995 | Dawson et al. | 340/825.31 |
| 5,488,350 | A | | 1/1996 | Aslam et al. | 338/225 D |
| 5,488,660 | A | | 1/1996 | Dawson et al. | 380/24 |
| 5,508,691 | A | * | 4/1996 | Castleman et al. | 340/825.31 |
| 5,552,777 | A | | 9/1996 | Gokcebay et al. | 340/825.31 |
| 5,587,702 | A | | 12/1996 | Chadfield | 340/542 |
| 5,617,082 | A | | 4/1997 | Denison et al. | 340/825.31 |
| 5,854,797 | A | | 12/1998 | Schwartz et al. | 371/22.1 |
| 5,870,914 | A | | 2/1999 | Dawson | 70/278 |
| 5,893,283 | A | | 4/1999 | Evans et al. | 70/303 A |
| 5,896,026 | A | | 4/1999 | Higgins | 320/166 |
| 5,918,988 | A | | 7/1999 | Van Oijen | 400/76 |
| 6,046,558 | A | * | 4/2000 | Larson et al. | 318/283 |
| 6,047,575 | A | * | 4/2000 | Larson et al. | 70/278.1 |

FOREIGN PATENT DOCUMENTS

| | | |
|---|---|---|
| GB | 2 144 483 A | 3/1985 |
| WO | WO 89/11577 | 11/1989 |
| WO | 98/39538 | 9/1998 |
| WO | 98/57017 | 12/1998 |

OTHER PUBLICATIONS

WO Search Report.

* cited by examiner

*Primary Examiner*—William A. Cuchlinski, Jr.
*Assistant Examiner*—Tuan C To
(74) *Attorney, Agent, or Firm*—Calfee, Halter & Griswold LLP

(57) ABSTRACT

The lock construction of the present invention has a lock body defining an interior cavity and a shackle that is releasably received in the interior cavity. The shackle is movable to a locked position for securing to an object and an unlocked position for releasing the object between the shackle and the lock body. A locking mechanism is disposed within the interior cavity of the lock and comprises rotatable first and second members. A motor is included to rotate said second member and thereby rotate the first member to secure and release the shackle between the locked and unlocked positions.

41 Claims, 7 Drawing Sheets

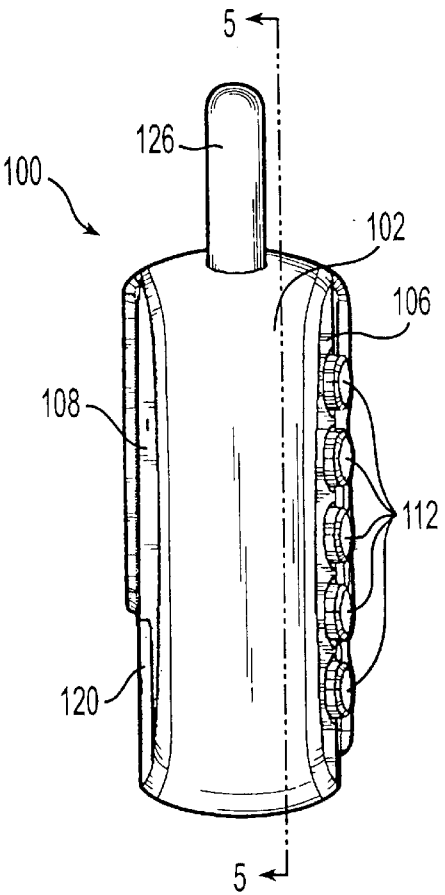
Fig. 1
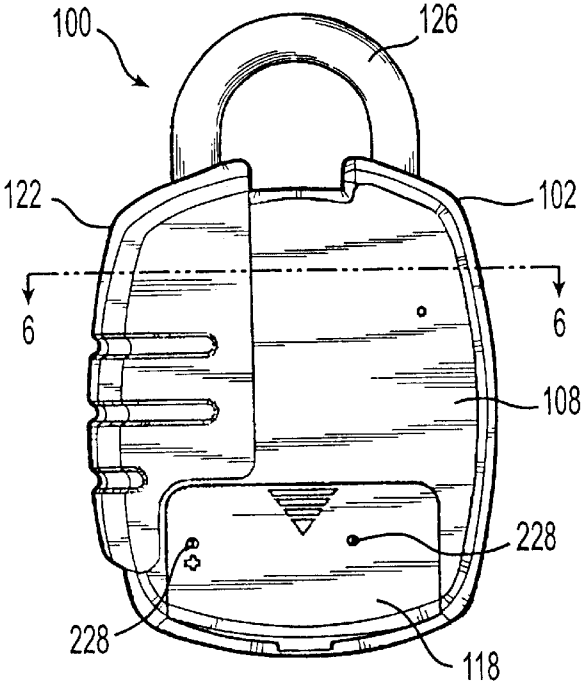
Fig. 2
Fig. 3

LOCK CONSTRUCTION

BACKGROUND OF THE INVENTION

The present invention relates generally to lock devices, particularly electronic lock devices such as electronic padlocks. Presently, many different types of electronic lock devices are used to secure doors, safes, vaults, and automobiles. Some of the more notable lock devices include those developed by the Mas-Hamilton Group, which are used primarily for safes and vaults. In particular, U.S. Pat. Nos. 5,170,431 and 5,893,283 disclose locks having electromechanical locking systems. Other devices, combining the electromechanical locking device with an electronic combination systems, are disclosed in U.S. Pat. Nos. 5,451,934, 5,488,350, and 5,488,660. Improvements on these lock devices include the addition of a self-contained power generation systems, as shown in U.S. Pat. No. 5,870,914, and power conservation systems, as shown in U.S. Pat. No. 5,896,026. Similarly, U.S. Pat. No. 5,617,082 discloses an electronic lock device having a single microprocessor, battery power, and keypad input.

Each of the previously cited lock devices are used in applications having unique characteristics that make the device operational for use with conventional electromechanical locking systems. For example, an automobile has a significantly large power source to power the lock. Similarly, a vault is often a large, heavy locking device that provides space for a large power source with substantial weight that dampens the effect of vibrations.

The power consumption required to operate electromechanical locks and the shock absorption characteristics often determine the size and the level of security afforded by the locking device. For example, a lock with a significant power source often provides a high level of security for a lock device due to its ability to manipulate heavier or multiple locking components. Additionally, a lock's shock absorption characteristics allow the lock to remain secured when the lock is exposed to external tampering.

These characteristics have prevented the successful construction of an electronic lock that is sufficiently compact for use as a portable padlock while providing high levels of security. Reducing the size of the lock necessitates reducing the size of the power source used to operate the lock. Simply reducing the size of the power source contained in the lock, however, often results in unreliable operation of the lock due to the low power output provided by the power source such that the lock may be compromised by even a slight frictional resistance. On the other hand, constructing a lock having a sufficient level of security has, in the past, required significant power consumption and accordingly results in frequent power source replacements when a reduced size power source is used.

Moreover, locks that are conducive for use as a padlock require portability and reliability while providing sufficient strength and shock resistance necessary to withstand external forces that are quite different from safes and doors. A free hanging padlock is particularly vulnerable to shock loads from striking and other external forces such that the lock requires greater resistance to vibration. Additionally, power consumption for portable locks must also be minimized to allow the use of a light weight power source that provides sufficient usage life of the lock between power supply replacements.

Accordingly, there is a need for an electronic padlock that has a sufficiently reduced size to provide functionality and portability for everyday use. In particular, there is a need for a lock having an internal locking mechanism that sufficiently minimizes the power consumption requirements and provides proper lock operation with high level of security while allowing a sufficient battery life that is convenient to the user.

SUMMARY OF THE INVENTION

The lock construction of the present invention has a lock body defining an interior cavity and a shackle that is releasably received in the interior cavity. The shackle is movable to a locked position for securing to an object and an unlocked position for releasing the object between the shackle and the lock body. A locking mechanism is disposed within the interior cavity of the lock and comprises rotatable first and second members. The first member has a toothed section and is rotatable between a first position, to secure the shackle in the locked position, and a second position, to release the shackle for movement to the unlocked position. The second member includes a threaded section that is configured to intermesh and rotate with the toothed section of the first member. A motor is also included to rotate the second member and thereby the first member to respectively secure and release the shackle between the locked and unlocked positions.

BRIEF DESCRIPTION OF THE DRAWINGS

FIG. 1 is a front view of one embodiment of a lock construction according to the present invention;

FIG. 2 is a back view of the lock construction in FIG. 1;

FIG. 3 is a side view of the lock construction in FIG. 1;

DESCRIPTION OF THE PREFERRED EMBODIMENT

Figure 4:
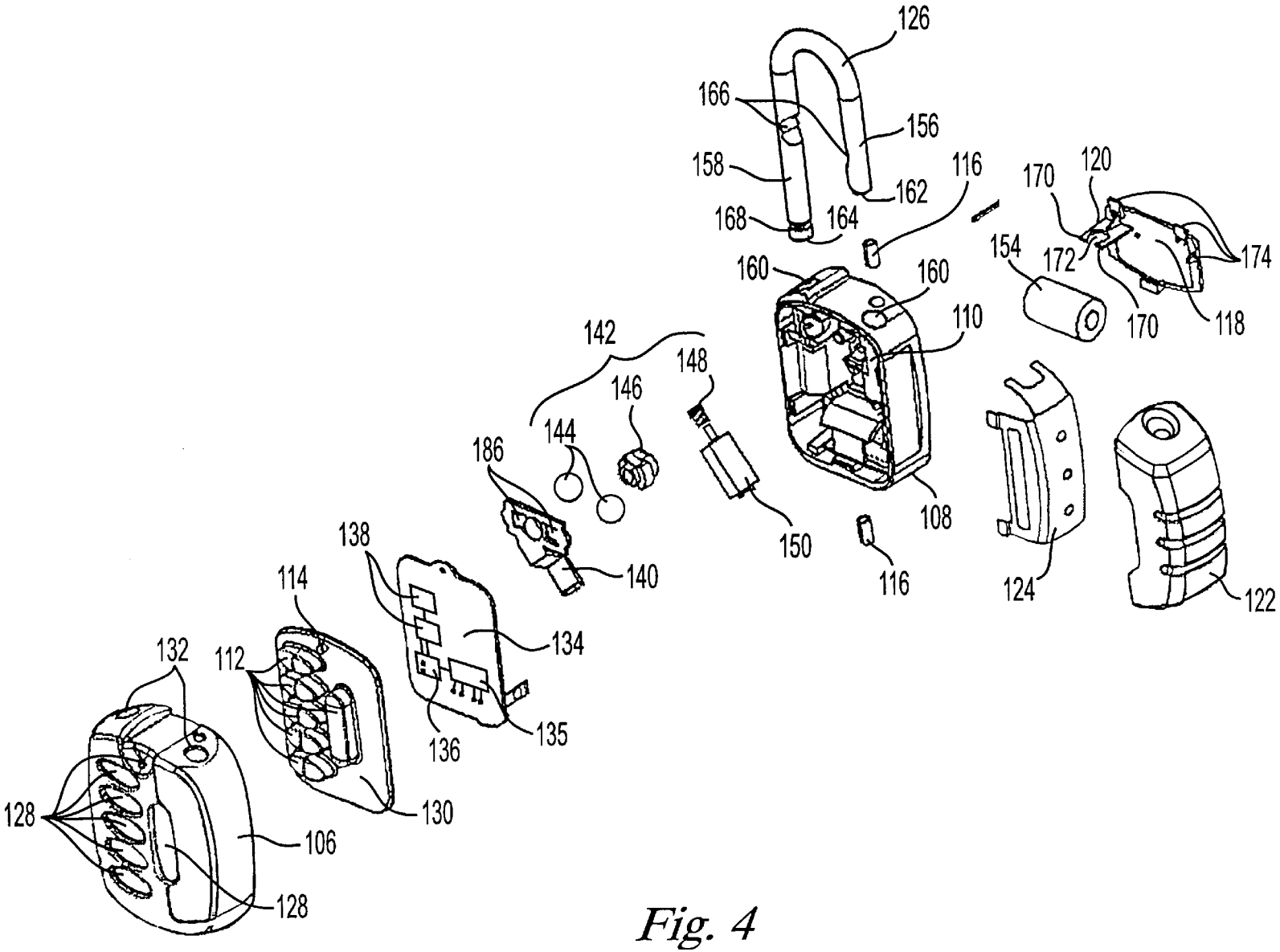
FIG. 4 is an exploded view of the lock construction of FIG. 1, showing the operating elements contained therein.

The lock construction 100 of the present invention includes a lock body 102 constructed from two interlockable portions, an outer shell 106 and an inner cartridge 108, as shown in FIGS. 1–3. The outer shell 106 and inner cartridge 108 interlock such that the inner cartridge 108 is fitted within the outer shell 106, forming a secured interior cavity 110, as shown in FIG. 4. Pins 116 are used to secure the inner cartridge 108 to the outer shell 106. The lock body 102 can be made of any ferrous or non-ferrous material such as steel, aluminum, zinc, or molded plastic.

The outer wall of the outer shell 106 forms the front and side portions of the lock construction 100, as shown in FIGS. 1 and 3, and exposes a user interface keypad 130. The keypad 130 has a plurality of keys 112 for inputting codes, such as an access code in the form of a personal identification number (PIN). A flashing light emitting diode (LED) 114 is also shown in FIG. 1 to assist the user with the operation of the lock 100. The lock construction 100 may additionally have an audible feedback device to assist with the operation and programming of the lock construction 100. The outer wall of the inner cartridge 108 forms the back portion of the lock construction 100, as shown in FIG. 2. The inner cartridge 108 has a cut-out portion for receiving an outer door 118 that is removable to provide access to the interior cavity 110 of the lock body 102.

Referring now to FIG. 4, the outer door 118 is has a projection 120 in a shape of a partial ring that extends substantially perpendicularly from the outer door 118 toward the interior cavity 110 of the lock construction 100. Preferably clips 174 are disposed on the outer door 118 such that when the outer door 118 is fitted over the cutout of the inner cartridge 108, the clips 174 hold the outer door 118 in place, securing the outer door 118 to the inner cartridge 108.

An exterior cushioning grip 122 is provided to fit over the lock body 102 and is preferable mechanically attached to the lock body 102 by a snap fit or adhesives. The grip 122 is a part of a modular system whereby the color and style of the grip 122 can be selected and coded to match the color of the remaining part of the lock 100. The grip 122 additionally covers any seams and rivet holes in the lock body 102. The grip 122 is dimensioned to inhibit abrasive contact between the lock body 102 and the object to be secured and to contribute to the overall ergonomic shape and appearance. The grip 122 is constructed from materials selected to provide cushioning and comfort in the hand of the user. Suitable materials include thermoplastic foam or rubber materials.

The grip 122 is shown in FIG. 4 in association with an integral grip carriage 124 for securing the grip 122 to the lock body 102. The grip carriage 124 has a form-fitting shape for accepting a portion of the lock body 102. The grip 122 is molded over the grip carriage 124, and the combination is mechanically attached by a snap fit or adhesives to the exterior of the lock body 102. As stated earlier, the grip 122 is constructed of a cushioning material. The grip carriage 124, on the other hand, is constructed of a substantially more rigid material to provide structure and support for the grip 122.

The lock construction 100 includes a shackle 126 slidable toward and away from the lock body 102. The shackle 126 is associated with the lock body 102 for movement between a locked position for securing an object between the shackle and the lock body, and an unlocked position for releasing the object secured between the lock body 102 and the shackle 126.

The interior of the lock 100 and the parts contained therein are shown in the exploded view of the lock construction 100 in FIG. 4. The outer shell 106 has a plurality of cutouts 128 for exposing a user input device in the form of keys 112 on a keypad 130. The cutouts 128 further exposes the LED 114. Shackle openings 132 are also disposed on the outer shell 106 for receiving the shackle 126. The keys 112 and the LED 114 on the keypad 130 are in alignment with their respective cutouts 128 of the outer shell 106 for exposing the keys 112 and the LED 114 therethrough when the keypad 130 is assembled adjacent to the front portion 106.

A circuit board 134 is disposed adjacent to the keypad 130 for processing information entered by the user through the keypad 130. The circuit board 134 includes a controller 135, a processor 136 and memory devices 138 for processing information entered by a user through the keypad 130 to operate the lock 100, the details of which will be discussed in greater depth hereinafter. Processors known in the art are used with the present invention. Other types of operating devices, however, may also be used. The keys 112 on the keypad 130 are preferably constructed of silicone rubber. The use of silicone rubber between the outer shell 106 and the circuit board 138 helps seal the cutouts 128 of the outer shell 106 and protects the circuit board 138. Other materials, however, may also be used in constructing the keys 112 and are contemplated with the present invention.

A locking mechanism 142, comprising a first member in the form of a locking cam 146, a second member in the form of a worm drive 148, and a third member in the form of ball bearings 144, is used to allow the shackle 126 to move between the locked and unlocked positions. As discussed more fully below, a spring member in a form of a plate and constructed of a resilient material or a spring plate 140 is operatively associated with the locking mechanism 142. The locking mechanism 142 is further connected to a motor 150 for operating the locking mechanism 142. A power source 154 is used to drive the motor 150 to operate the locking mechanism 142. In the preferred embodiment, a DC motor is used as the motor 150, and the power source 154 is in the form of a battery, preferably a conventional 3V-lithium battery. Other power sources 154 may also be used with the present invention.

The shackle part 126 of the lock construction 100 has a short leg 156 and a long leg 158. The short leg 156 is completely removable from the lock body 102 when the lock is in the unlocked position. The long leg is slidably mounted within the lock body 102. The short and long legs 156 and 158 are slidably received within the interior cavity 110 of the lock body 102 through a set of shackle openings 160 disposed on the inner cartridge 108. When the lock construction 100 is assembled, the shackle openings 160 of the inner cartridge 108 and shackle openings 132 of the outer shell 106 are aligned with respect to each other to receive the shackle 126 for slidable movement therethrough. The short leg 156 has a first end 162, and the long leg 158 has a second end 164. Both legs 156 and 158 of the shackle 126 include shackle recesses 166 for receiving the ball bearings 144. The long leg 156 additionally has a notch 168 disposed proximately to the second end 164, as explained below, in more detail.

Figure 5:
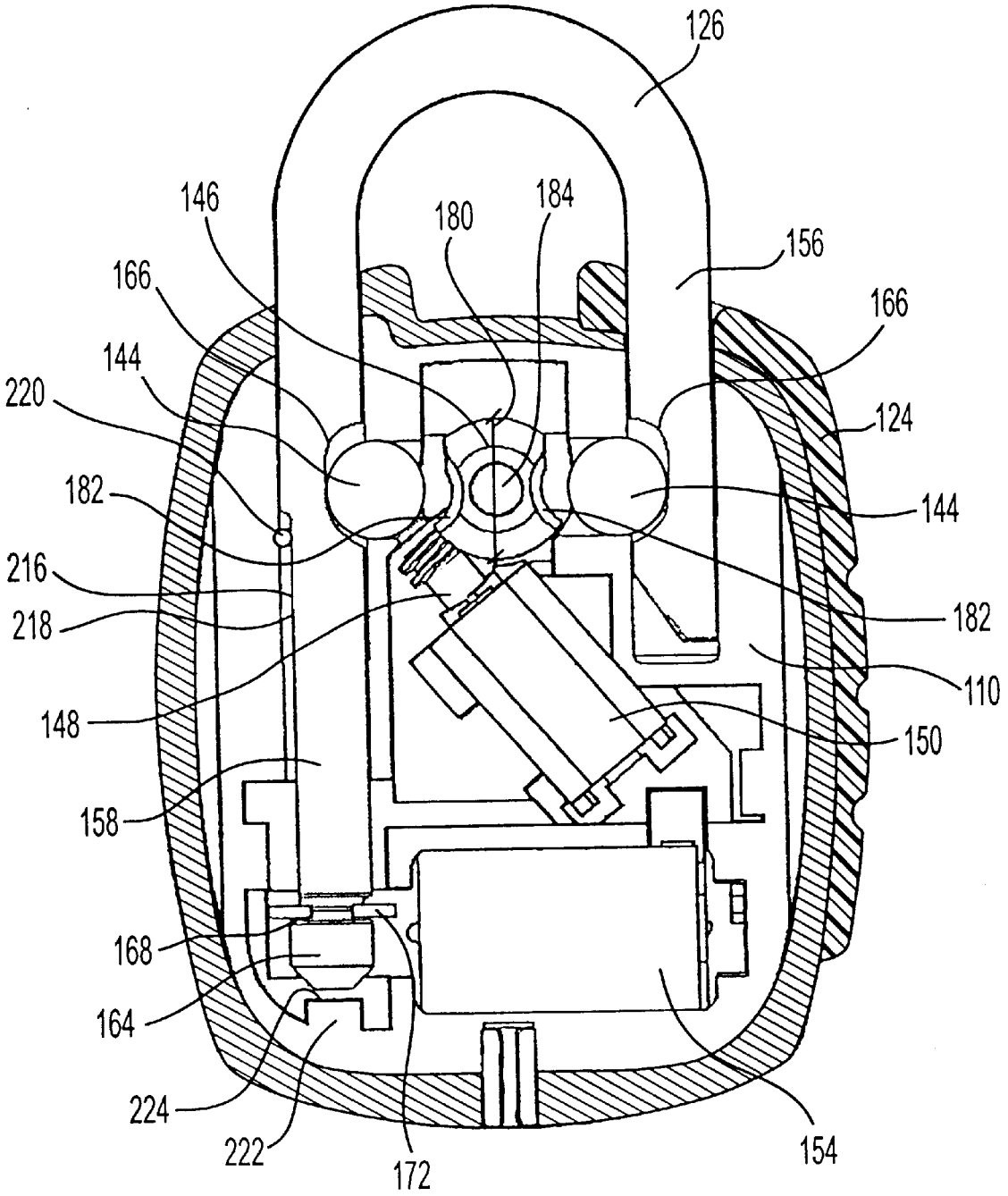
FIG. 5 is a cross-sectional view of the lock construction in FIG. 3 along lines 5—5, showing the operating elements as assembled.
Figure 6:
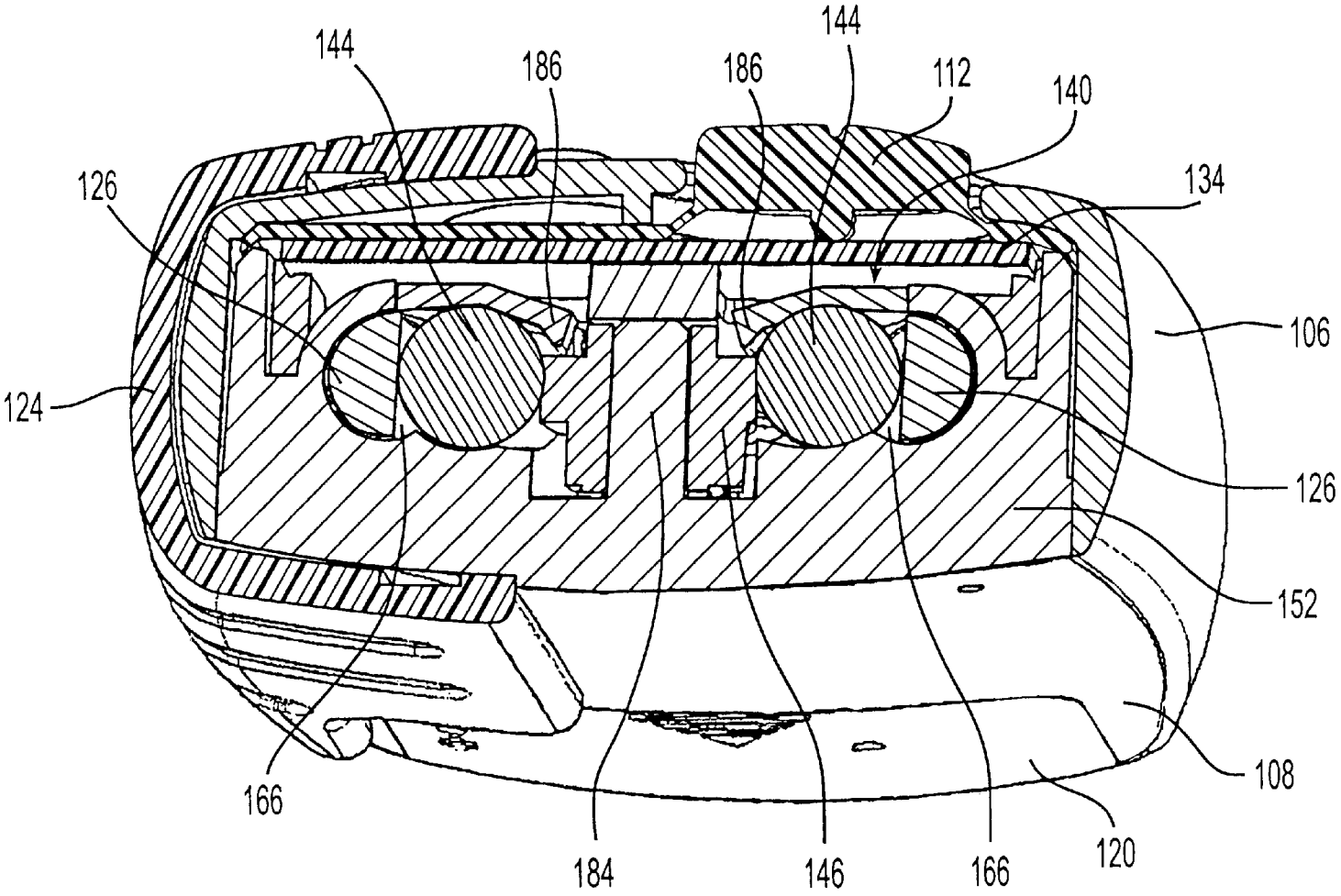
FIG. 6 is a top perspective cross-sectional view of the lock construction in FIG. 2 along lines 6—6, showing the operation elements as assembled.
Figure 7:
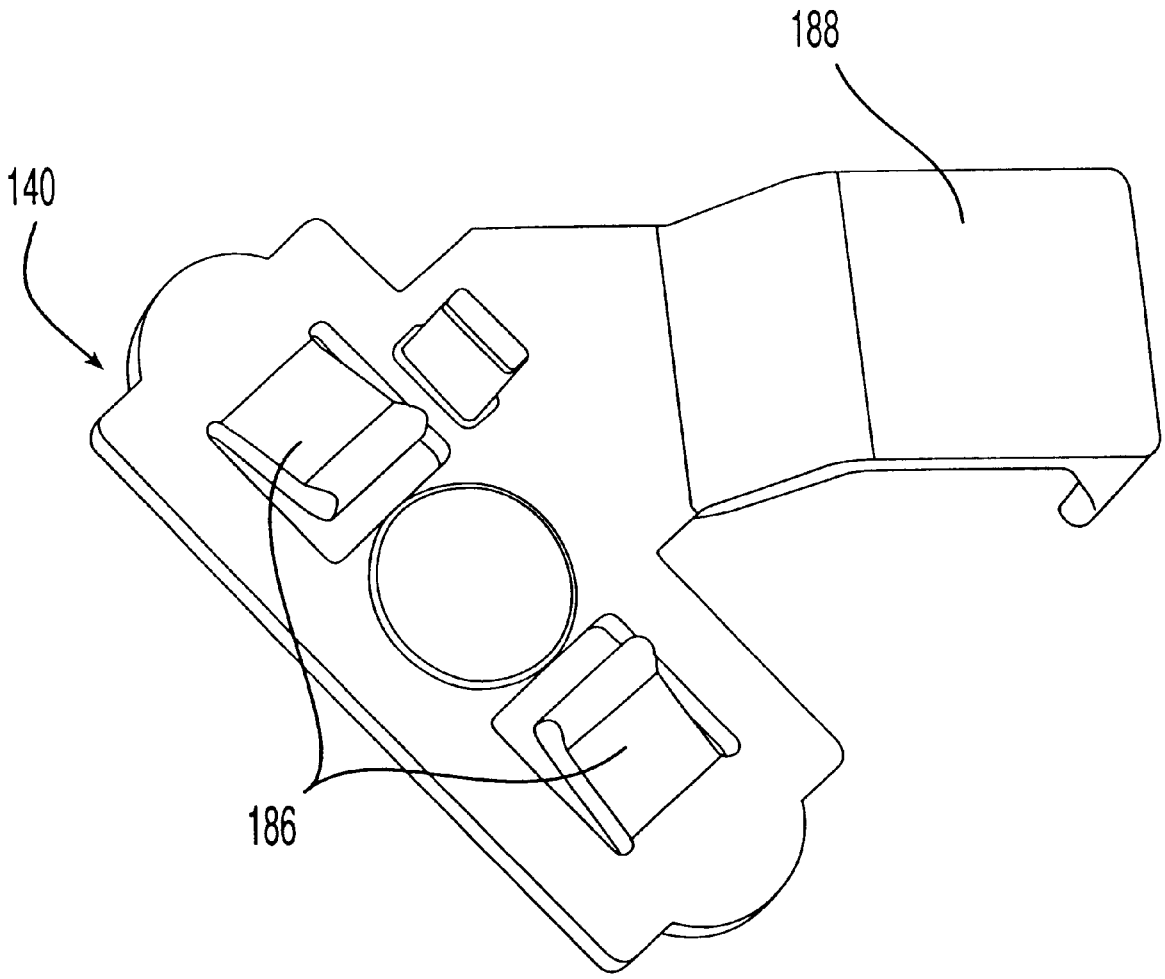
FIG. 7 is a perspective view of a spring plate for the lock construction in FIG. 1.

FIG. 5 shows the interior cavity 110 and some of the previously described parts assembled therein when the lock construction 100 is in the unlocked position. The locking cam 146 has a major diameter 180 and two opposed recesses or semi-spherical scallops 182. The spherical scallops 182 are disposed on opposing sides of the locking cam 146 with the major diameter 180 extending along the perimeter of the locking cam 146 between the spherical scallops. As shown, the scallops 182 are in alignment with the ball bearings 144 and the shackle recesses 166 of the shackle 126 such that pulling on the shackle 126 will cause the ball bearings 144 to move inwardly and be received by the spherical scallops 182 of the locking cam 146. In this manner, the short leg 156 of the shackle 126 is releaseable between the locked and unlocked positions by sliding the shackle 126 in and out of the interior cavity 110. On the other hand, when the major diameter 180 is aligned with the ball bearings 144 and the shackle recesses 166, as shown in FIG. 6, the ball bearings 144 are prevented from lateral movement toward the locking cam 146 such that pulling on the shackle 126 forces the shackle recesses 166 to engage the ball bearings 144, preventing removal of the shackle 126 from the interior cavity 110. The lock construction 100 is accordingly in the locked position.

The locking cam 146 rotates on a pin bearing 184, protruding from the interior cavity 110 through the center of the locking cam 146. The pin bearing 184 also secures the spring plate 140 within the interior cavity 110. The spring plate 140 is constructed with two opposing angular arms 186, extending at an angle from the base portions 188 of the spring plate 140. The arms 186 are constructed to receive and engage and further urge the ball bearings 144 away from the scallops 182 of the locking cam 146 toward the shackle recesses 166. The angle of the arms 186 of the spring plate 140, however, are constructed to allow sufficient lateral movement of the ball bearings 144 toward the locking cam 146, while preventing abutting engagement of the ball bearings 144 with the interior surface of the scallops 182, when the scallops 182 are in alignment with the ball bearings 144.

By applying pressure on the ball bearings 144 in an outwardly direction away from the locking cam 146, as shown in FIG. 6, the arms 186 prevent the ball bearings 144 from frictionally engaging or being wedged in the scallops 182 of the locking cam 146. Additionally, the angled arms 186 allow the ball bearings 144 to move sufficiently away from the shackle recesses 166 toward the scallops 185 when the shackle 126 is pulled away from the interior cavity 110. The spring plate 140 essentially acts as a spring, biasing the ball bearings 144 away from the locking cam 146 and assisting with the return of the ball bearings 144 into engagement with the shackle recesses 166 upon reinsertion of the shackle 126. Once the ball bearings are received within the shackle recesses 166, the arms 186 of the spring plate additionally serves to retain the ball bearings 144 therein. Thus, the locking cam 146 is allowed to rotate substantially free of frictional engagement or contact with the ball bearings 144 between the first and second positions, and thereby minimizing the power required to rotate the locking cam 146.

Figure 8:
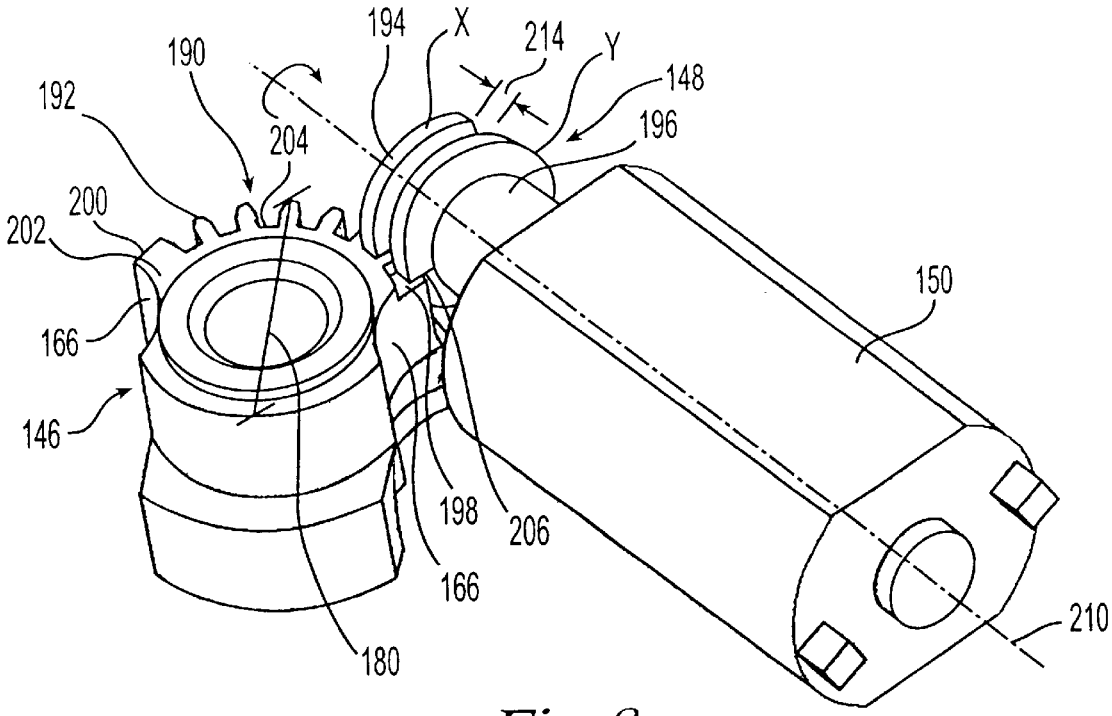
FIG. 8 is a perspective view of first and second members for the lock construction in FIG. 1, showing the lock construction in a locked position.
Figure 10:
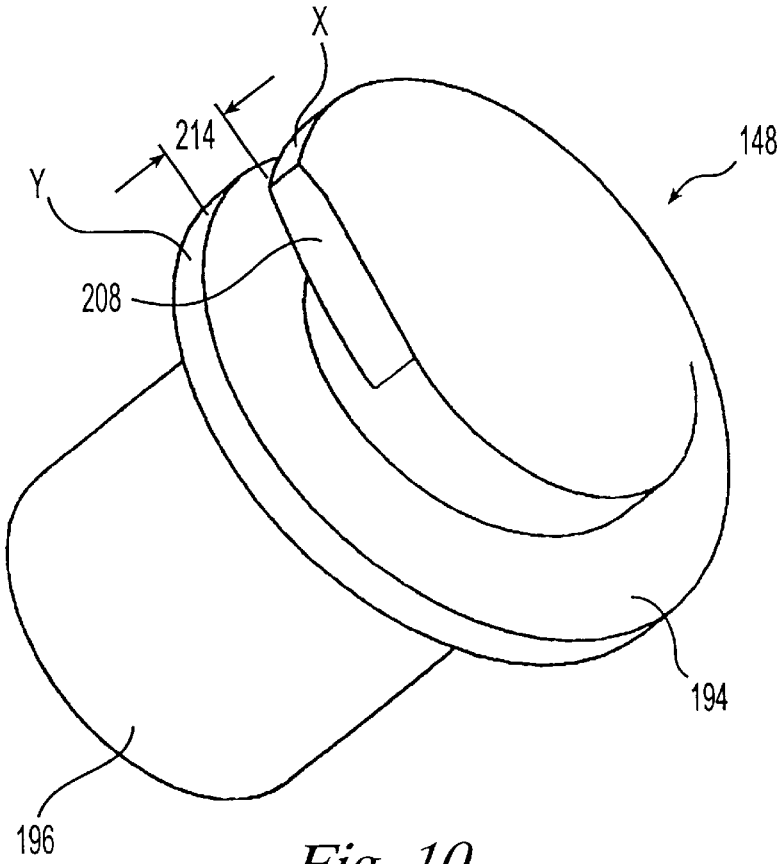
FIG. 10 is an enlarged view of the top portion of the second member.
Figure 9:
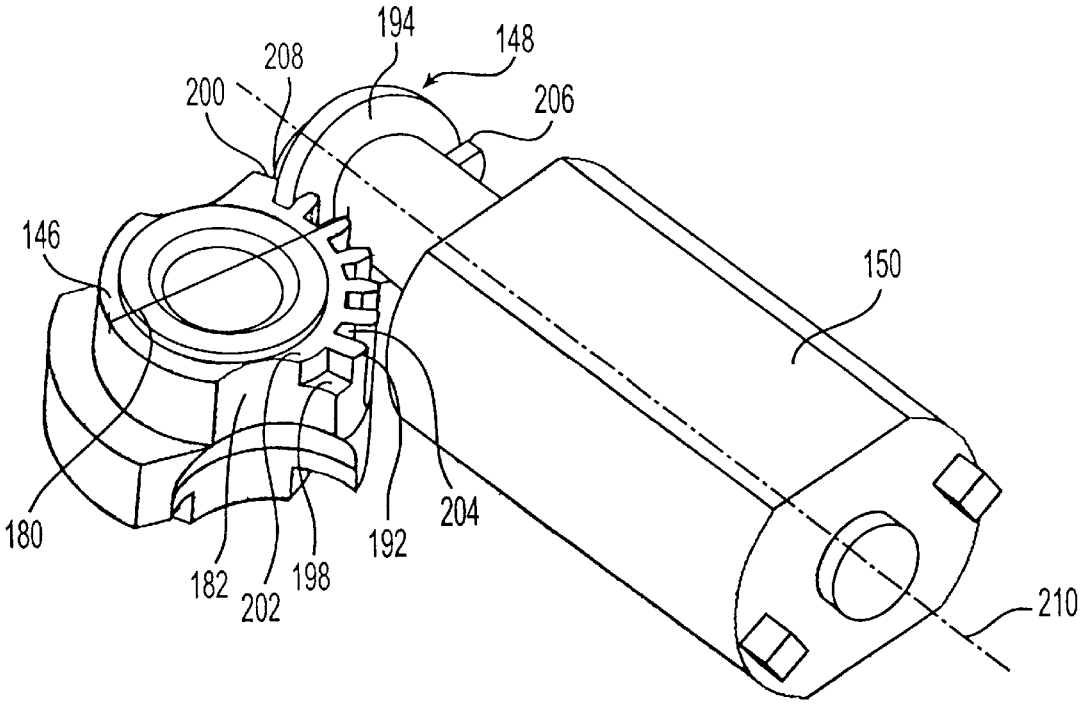
FIG. 9 is a perspective view of the first and second members for the lock construction in FIG. 1, showing the lock construction in an unlocked position.
Figure 9A:
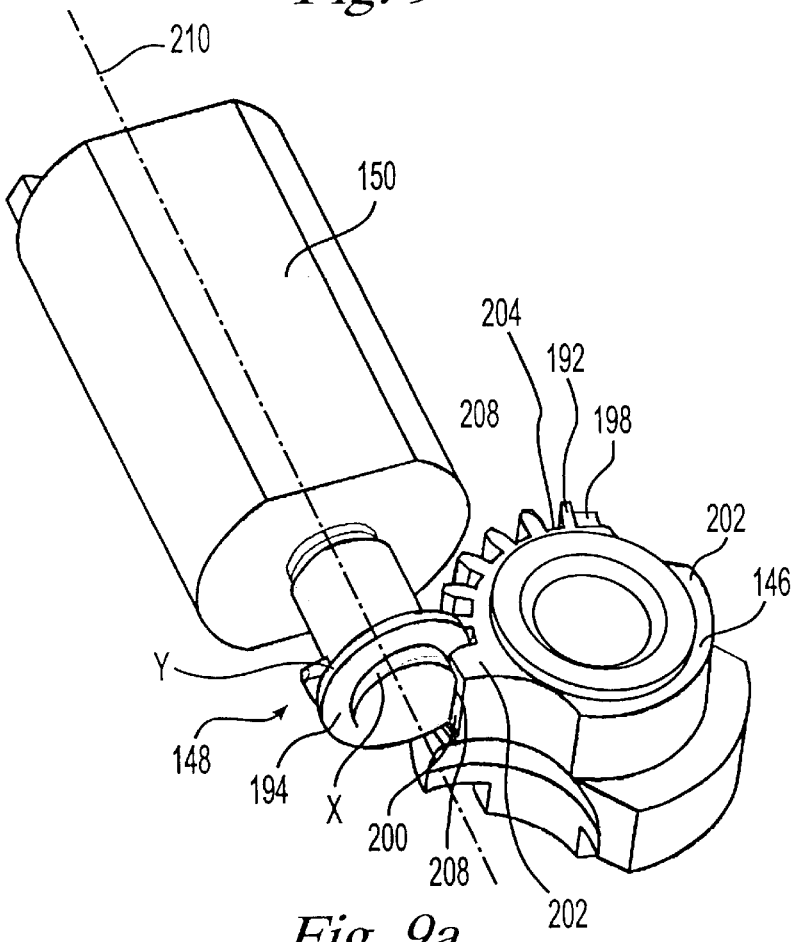
FIG. 9*a* is a second perspective view of the first and second members for the lock construction of FIG. 1, showing the lock construction in an unlocked position.

The details the locking cam 146, worm drive 148 and motor 150, are shown in FIGS. 8 through 10. FIG. 8 shows the locking mechanism 142 in the first position to secure the shackle in the locked position, and FIGS. 9 and 9*a* show the locking mechanism 142 in the second position to release the shackle for movement to the unlocked position. The locking cam 146 is constructed with a toothed section 190, having teeth 192 that are disposed along the major diameter 180 on one side of the locking cam 146. The worm drive 148 has a helical thread 194 that is preferably integrally constructed with the shaft 196 of the worm drive 148. The thread may be molded, machined or cast on to the shaft 196 for a single-piece construction. The shaft 196 is connected to the motor 150 for rotating the shaft 196. The thread 194 of the worm drive 148 intermeshes with the teeth 192 of the locking cam 146 for rotating the locking cam, upon energizing the motor 150.

The locking cam 146 further includes first and second stops 198 and 200 disposed at opposing ends of the toothed section 190. The worm drive 148 includes first and second end surfaces 206 and 208. The first end surface 206 is substantially perpendicular to the helical thread 194 and is configured to contact the first stop 198 of the locking cam 146, as shown in FIG. 8. The second end surface 208 is also substantially perpendicular to the helical threads 194, as shown in FIG. 10, and is configured to contact the second stop 200 of the locking cam 146, as shown in FIG. 9*a*. The locations of these contact surfaces 206 and 208 limit the rotation of the locking cam 146 within a range defined by the toothed section 190 of the locking cam 146. In other words, the stops 198 and 200 and ends 206 and 208 are configured to align the lock cam 146 in either the first position, with the major diameter 180 in alignment with the ball bearings 144, or the second position, with the scallops 182 in alignment with the ball bearings 144, when the locking cam 146 is rotated respectively therebetween.

Moreover, the stops 198 and 200 and ends 206 and 208 are configured such that the worm drive 148 and the locking cam 146 stop in instantaneous full abutting engagement against each other, as opposed to a gradual contact of their surfaces, after each rotation of the locking cam 146 and worm drive 148 between the first and second positions without contacting any other parts of the lock construction 100. In other words, the stops 198 and 200 and end surfaces 206 and 208 stop against each other to minimize frictional engagement and to provide non-binding rotation of the locking cam 146 and worm drive 148.

The helical thread 194 of the worm drive 148 forms a number of rotations about the shaft 196 of the worm drive 148 between the end surfaces 206 and 208 of the thread 194. The thread 194 additionally includes a pitch 214, defined as the distance between adjacent axial portions of the thread 194. The toothed section 190 of the locking cam 146 is configured with a number of teeth 192. The number of teeth 192 on the locking cam 146 and the number or rotation of thread 194 on the shaft 196 are coordinated to ensure proper intermeshing engagement therebetween and to prevent unintended rotation or movement of the shaft 196 and thereby rotation of the locking cam 146 due to vibration. The number of rotations that the helical thread 194 makes about the shaft 194 is configured to minimize the number of rotations required for the worm drive 148 to rotate the locking cam 146 between the first and second positions. The helical thread 194, however, must not provide so few rotations or that the pitch must not be large that external impact to the lock 100 can easily loosen the contact between the end surfaces 206 and 208 and the stops 198 and 200. Such loosened contact may result in the unintentional rotation of the locking cam 146 and thereby compromising the security of the lock 100.

For example, the thread 194 must have a thickness that corresponds to the pitch 214 such that the thread 194 intermeshes between teeth 192 and engages therewith to rotate the locking cam 146 without wedging the thread 194 therein. Additionally, the number of teeth 192 on the locking cam 146, the overall diameter of the locking cam 146 and the desired rotation of the locking cam between the first and second positions are all factors in determining the number or rotations that the thread 194 makes about the shaft 196. As shown in FIGS. 8, 9*a* and 9*b*, the preferred embodiment of the present invention shows thread 194 revolving about the shaft 196 approximately one and a half rotations and the locking cam 146 having about 6 teeth 192 between stops 198 and 200.

The toothed section of the preferred embodiment extends over an arc of about 100° between the two stops 198 and 200. Rotating the shaft 196 rotates the worm drive 146, and the thread 194 thereby engages the teeth 192 to move the locking cam 146 from the first position with the end surface 206 engaged against the stop 198 of the locking cam 146, as shown in FIG. 8, to the second position with the end surface 208 engaged against the stops 200 of the locking cam 146, as shown in FIG. 9*a*. As used in the art, a transmission ratio is defined by the number of rotations the worm drive 148 must make to rotate the locking cam 146 a complete turn or 360°. In the present invention, the locking cam 148 only needs to rotate partially of a complete turn 360° between the first and second positions. Accordingly, a transmission ratio of 20 to 24 would indicate that the worm drive 148 rotates about 5 to 6 rotations to rotate the locking cam 146 a quarter turn, or 90°.

As stated previously, the worm drive 146 and the locking cam 146 are constructed to minimize the required rotation of the worm drive 148 to rotate the locking cam 146 between the first and second positions while preventing inadvertent rotation of the locking cam 146 due to vibration to the lock construction 100. Moreover, the lock construction 100 is in the unlocked position as long as the ball bearings 144 are in alignment with the scallops 182 and the shackle recesses 166. Accordingly, to allow the shackle 126 to move between the locked and unlocked positions, the worm drive 148 rotates between about 3 to 8 revolutions to rotate the locking cam 146 at least about 45° to 120° between the first and second positions. Most preferably, the worm drive 148 rotates about 5 to 6 revolutions to rotate the locking cam 146 about 90° or approximately 1 revolution of the worm drive 148 for every 15° rotation of the locking cam 146. By optimizing the transmission ratio between the locking cam 146 and the worm drive 148 to achieve the required rotation of the locking cam 146 between the first and second positions, the power consumption of the lock 100 is greatly minimized, thereby extending the useful life of the lock 100 between power source 154 replacements.

Referring back to FIG. 5, the long shackle leg 158 has a flat side 216 that includes a groove 218. The groove 218 receives a retaining pin 220 to limit the outward movement of the shackle 126 away from the interior cavity 110. The pin 220 further engages the notch 168 of the long shackle leg 158 to permit free rotation of the shackle 126 when it is slidably moved to the unlocked position. Also the projection 120 of the outer door 118, includes ends 170 which wrap around the long shackle leg 158, at the level of the notch 168, when the outer door 118 is assembled to the lock body 102. The projection 120 has an opening 172 through which the leg 158 can move in the vertical direction; but the ends 170 prevents the removal of the outer door 118 when the shackle leg is engaged in the projection 120. Accordingly, the outer door 118 can only be removed when the lock 100 is opened and the shackle 126 has been shifted vertically upwardly to disengage it from the projection 120 of the outer door 118.

In use, the lock construction 100 of the present invention is typically secured about an object with the lock hanging by the shackle 126 such that the weight of the lock construction 100 pulls the lock body 102 downwardly away from the shackle 126. Accordingly, in the locked position, the shackle 126 is usually placed in tension with respect to the lock body 102. Additionally, in the locked position, the major diameter 180 of the locking cam 146 is in alignment with the ball bearings 144 to prevent inward movement thereof and the lower portions of the shackle recesses 166 are usually in abutting engagement with the ball bearings 144, causing the ball bearings 144 to frictionally bind or engage against the locking cam 146, thus requiring more power to rotate the locking cam 146.

To eliminate any binding effect, as disclosed above, the lock construction 100 is constructed such that the shackle 126 is preferably not in tension just prior to the operation of the lock construction 100. For this purpose, a shackle stop 222, which is operatively connected to a sensor 224 is disposed in the interior cavity 110 of the lock construction 100. The shackle stop 222 is positioned to locate the shackle 126 is a predetermined location. As stated previously, the ball bearings 144 are biased outwardly by the arms 186 of the spring plate 140. Accordingly, when the shackle 126 is pushed toward the sensor 224, the downward movement of the shackle 126 relieves any inward pressure on ball bearings 144 when motor 150 is activated. Thereafter, pulling the shackle 126 permits the lock to open. Thus, this push/pull sequence used to initiate the operation of the lock 100 ensures proper alignment of the locking mechanism 142 with the shackle 126. Additionally, the proper alignment and retainment of the ball bearings 144 within the shackle recesses 166 allow substantially contact free rotation of the locking cam 146. These features combine to minimize the power consumption of the lock 100 during operation.

When the long leg 158 of the shackle 126 is slidably pushed downwardly within the interior cavity 110 so that the end 164 of the long leg contacts the sensor 224, the power source is activated to thereby permit the operation of the motor 150. The sensor 224 is shown in FIG. 5 as being atop the shackle stop 222. The sensor 224, however, may also be connected to the circuit board 138 with a protrusion that is in alignment with the shackle stop 222. With either configuration, the sensor 224 is connected to the circuit board 138 for providing and receiving instructions therefrom. When contact is made between the end 164 and the sensor 224 and the appropriate keys 112 on the keypad 130 have been entered, the sensor 224 signals the electronic circuit 110 to drive the motor 150. The sensor 224 additionally indicates to the processor 136 that await for the entry of an access code and to begin operation of the lock 100. Accordingly, the push/pull sequence additionally ensures that the power source 154 is activated to drive the motor 150 only when operation of the lock 100 is intended.

By minimizing the frictional resistance for the rotation of the locking cam 146 with respect to the worm drive 148 and the locking cam 146 with respect to the ball bearings 144, as described above, the required power to operate the lock 100 is greatly reduced. These features thus combine to extend the useful life of the power source 154. Moreover, if the power source 154 fails while the lock 100 is in the locked position, the outer door 118 permits the application of auxiliary power through two small openings 228, best seen in FIG. 2, enabling the lock 100 to be opened using authorized codes.

The processor 136 of the lock construction 100 is programmable to perform various functions in the operation of the lock construction 100. These functions include adding, changing and deleting authorization codes for locking and unlocking the lock 100. Other programmed functions may also be included to provide greater convenience and flexibility to the user. For example, a function may be included to confirmed an access code during a programming sequence to verify that no input errors were made. Another function may provide the user with the option to allow a one time access to a particular authorization code to operate the lock 100. A program may be directed to searches for keypad input within a fixed period of time and stores it in memory. Additionally, a program may be directed to compare the access codes entered on the keypad with codes stored in memory.

A few exemplifying operations of the lock are now described with respect to the above shown preferred embodiment. As stated earlier, the front of the lock 100 presents the keypad 130 user interface for entering an access code, commonly referred to as a personal-identification number or PIN. Other configuration of the keypad 130, however, are also contemplated by the present invention. The keys are numbered 0–9 and "ENTER," and these keys permit the programming of separate user codes and a single-use code that expires immediately upon entry. The "ENTER" key, used during normal operation, signals a request to open the lock 100. The "ENTER" key is also used to separate different functional and code entries or to confirm code inputs when programming the lock 100.

When the lock 100 is open, some of the numerical keys may be programed to convert to function keys to enable an authorized user to add, delete or modify codes using a programming sequence. As stated previously, the initial push/pull sequence, requiring a downward shackle movement toward the lock 100 followed by shackle movement away from the lock 100, properly positions the locking mechanism 142 for operation. Thereafter, an authorized access code may be entered to operate the lock 100. The processor 136 may be programed to provide a finite time limit within which the user must enter the access code correctly after the push/pull sequence, otherwise the entry instruction will expire and the lock 100 will remain secured.

The lock construction 100 of the present invention is preferably configured to allow only one master authorization code to operate and set all other authorization code combinations. The lock construction 100 is purchased by the user without an initially preprogrammed combination code. Accordingly, when the user enters the first access code, the code becomes the designated master code. Preferably, once the master code has been programmed, it can only be changed, but not deleted. Additionally, only the master code can be used to add additional user authorization codes for both multiple accesses or single-access.

To program the master code, the user enters the desire combination of numbers using the keypad 130 and press the "ENTER" key. The user thereafter must enter the same combination to confirm the previously entered combination followed by the "ENTER" key. The LED 114 will flash rapidly as the initial combination is stored as the master code. After these steps are completed the LED 114 will stop flashing and upon insertion of the shackle 126 toward within the interior cavity 110, the lock 100 will lock. If an error occurs during the entry of the initial authorization code, the LED 114 will remain flashing. For example, if the confirmation entry of the authorization code does not match the initial combination entered, the LED 114 will flash to indicate such error and the programming sequence may be repeated to ensure proper entry of the master code. After properly programming the master code, other functions maybe programed in a similar fashion by first entering the master code.

It will be appreciated that those skilled in the art may devise numerous modifications and embodiments. For example, the keypad 110 for user interface can easily be modified to an electronic key instead of the combination input keypad. By replacing the keypad 130 with a touch memory reader, a Dallas Semiconductor i-button module can be used as a key to operate the lock of the present invention. Similarly, a variety of access controls can be applied such as magnetic strip, fingerprint ID or a retinal scan to provide access to operate the lock. Additionally, the control features can be customized and expanded through increased memory, more powerful microprocessors, or modified software functions to support virtually any number of users desired or to store a log of all the transactions to provide an audit trail. Moreover, the lock of the present invention can also be constructed with a self-contained power generation system, or alternative electromotive means, all arranged according to similar principles as have been demonstrated in this invention.

All the above enumerated alternatives are contemplated for a lock constructed according to the present invention. It is intended that the following claims cover all such modifications and embodiments as they fall within the true spirit and scope of the present invention.

We claim:

1. A lock construction, comprising:

a) a lock body defining all interior cavity;

b) a shackle connected to said lock body and movable to a locked position for securing to an object between said shackle and lock body and an unlocked position for releasing said object secured therebetween;

c) a lock mechanism disposed within the interior cavity, including:

i) a rotatable first member having it toothed section and operatively connected to said shackle for rotation between a first position, to secure said shackle in said locked position in said lock body, and a second position, to release said shackle for movement to said unlocked position, and ii) a rotatable second member disposed adjacent to said first member and having a threaded section configured to intermesh and rotate with said toothed section of said first member, wherein said second member is rotated in a first direction to engage the lock mechanism and in a second direction to disengage the lock mechanism; and d) a motor for rotating said second member and thereby rotates said first member between said first and second positions to respectively secure and release said shackle.

2. The lock construction of claim 1, wherein said first member rotates in the range of about 45° to about 120° between said first and second positions.

3. The lock construction of claim 1, wherein said second member rotates up to about 6 revolutions to thereby rotate said first member up to about 90° between said first and second positions.

4. The lock construction of claim 1, wherein said second member rotates about 1 revolution to thereby rotate said first member about 15°.

5. The lock construction of claim 1, wherein:

a) said toothed section of said first member includes first and second stops at opposite ends thereof; and b) said threaded section of said second member intermeshes with said first member between said first and second stops between said first and second positions of said first member.

6. The lock construction of claim 5, wherein said toothed section includes about 6 teeth located between said first and second stops.

7. The lock construction of claim 5, wherein said threaded section of said second member is a helical thread forming a first number of rotations about said second member and having opposite end surfaces.

8. The clock construction of claim 1, wherein said second member rotates about 1.5 revolutions.

9. The lock construction of claim 1, wherein said first end surface engages said first stop when said first member is in said first position and said second end surface engages said second stop when said first member is in said second position.

10. The lock construction of claim 1, wherein said first and second end surfaces respectively engage said first and second stops in instantaneous and full abutting engagement when said first member respectively rotates to said first and second positions.

11. The lock construction of claim 1, further comprising:

a) a third member disposed within said interior cavity between said shackle and said first member; and b) at least one first member recess disposed on said first member for receiving said third member when said first member is in said second position to release said shackle for movement to said unlocked position.

12. The lock construction of claim 11, wherein:

a) said third member comprises two ball bearings; and b) said at least one first member recess includes two recesses for receiving said ball bearings.

13. The lock construction of claim 11, wherein said shackle comprises a shackle recess for receiving said third member when said first member is in said first position to secure said shackle in said locked position.

14. The lock construction of claim 13, further comprising a spring member engaging said third member and urging it away from said first member.

15. The lock construction of claim 14, wherein said first member recess includes an interior surface and said spring engages said third member to urge said third member away from contact with said interior surface of said first member recess when said first member is in said second position.

16. The lock construction of claim 14, wherein said third member is aligned between said first member recess and said shackle recess when said first member is in said second position to release said shackle in said unlocked position.

17. The lock construction of claim 14, wherein said third member is out of alignment with said first member recess when said first member is in said first position to secure said shackle in said locked position.

18. The lock construction of claim 14, further comprising:

a) a power source operatively connected to said motor for rotating said motor and thereby rotating said first member between said first and second positions;

b) a shackle stop operatively connected to a sensor disposed in said interior cavity of said lock body to activate said power source;

c) said shackle further comprising:

i) a short leg completely removable from said lock body when said lock is in said unlocked position, and ii) a long leg extending from said short leg and slidably mounted within said interior cavity; said long leg slidable toward said sensor of said shackle stop for contact therebetween to thereby activate said power source to operate said motor.

19. The lock construction of claim 18, wherein said third member is substantially aligned with said shackle recess when said long leg of said shackle is in contact with said sensor of said shackle stop and said first member is in said first position.

20. The lock construction of claim 19, wherein said spring member retains said third member within said shackle recess when said long leg of said shackle is in contact with said sensor of said shackle stop whereby when said power source is activated to operate said motor and thereby rotate said second member to rotate said first member, said first member is rotated substantially free of contact between said third member and said first member.

21. The lock construction of claim 1, wherein said second member is a worm gear which has a transmission ratio with respect to said first member in the range of about 10 and about 32.

22. A lock construction, comprising:

a) a lock body defining an interior cavity;

b) a shackle connected to said lock body and movable to a locked position for securing to an object between said shackle and lock body and an unlocked position for releasing said object secured therebetween;

c) a lock mechanism disposed within the interior cavity, including:

i) a rotatable first member having a toothed section and operatively connected to said shackle for rotation between a first position, to secure said shackle in said locked position in said lock body, and a second position, to release said shackle for movement to said unlocked position, and ii) a rotatable second member disposed adjacent to said first member and having a threaded section configured to intermesh and rotate with said toothed section of said first member; and d) a motor for rotating said second member a number of revolutions and thereby rotates said first member between said first and second positions, wherein said first member rotates about 45° to 120° between said first and second positions, to respectively secure and release said shackle.

23. The lock construction of claim 22, wherein said first member rotates about 90° between said first and second positions.

24. The lock construction of claim 22, wherein said second member is a worm gear which has a transmission ratio with respect to said first member in the range of about 10 to 32.

25. A lock construction, comprising:

a) a lock body defining an interior cavity;

b) a shackle connected to said lock body and movable to a locked position for securing to an object between said shackle and lock body and an unlocked position for releasing said object secured therebetween;

c) a lock mechanism disposed within the interior cavity, including:

i) a rotatable first member having a toothed section and operatively connected to said shackle for rotation between a first position, to secure said shackle in said locked position in said lock body, and a second position, to release said shackle for movement to said unlocked position, and ii) a rotatable second member disposed adjacent to said first member and having a threaded section configured to intermesh and rotate with said toothed section of said first member; and d) a motor for rotating said second member a number of revolutions and thereby rotates said first member between said first and second positions, wherein said second member rotates in the range of about 3 to about 8 revolutions.

26. The lock construction of claim 25, wherein said number of revolutions for said second member is about 6.

27. The lock construction of claim 1, further comprising:

a) a power source disposed within said interior cavity to provide power to drive said motor; and b) a user input device operatively connected to said power source for inputting at least one code; said at least one code activates said power source to drive said motor.

28. The lock construction of claim 27, further comprising:

a) a first memory device disposed in said interior cavity and coupled to said input device to store said at least one code as an access code;

b) a second memory device disposed in said interior cavity and coupled to said input device to store another of said at least one code as input code;

c) a processor coupled to said first and second memory devices to process said access and input codes; and d) a controller coupled to said processor and said power source to activate said power source to drive said motor;

wherein said processor transmits a signal when said access code matches said input code to said controller, activating said power source to drive said motor and thereby rotate said first and second members between said first and second positions allowing said shackle to move between said locked and unlocked positions.

29. The lock construction of claim 28, further comprising a shackle stop having a sensor and disposed in said interior cavity; said sensor for said shackle stop operatively connected to said processor, wherein contact between said shackle with said sensor allows said processor to process said access and input codes.

30. A lock construction, comprising:

a) a lock body defining an interior cavity;

b) a shackle connected to said lock body and movable to a locked position for securing to an object between said shackle and lock body and an unlocked position for releasing said object secured therebetween;

c) a lock mechanism disposed within the interior cavity, including:

i) a rotatable first member having a toothed section and operatively connected to said shackle for rotation between a first position to secure said shackle in said locked position in said lock body, and a second position, to release said shackle for movement to said unlocked position, and ii) a worm gear disposed adjacent to said first member and having a threaded section configured to intermesh and rotate with said toothed section of said first member; and d) a motor for rotating said worm gear and thereby rotates said first member between said first and second positions to respectively secure and release said shackle.

31. The lock construction of claim 30, wherein said worm gear has a transmission ratio with respect to said first member in the range of about 10 to about 32.

32. The lock construction of claim 30, wherein said worm gear has a transmission ratio with respect to said first member in the range of about 20 to about 24.

33. The lock construction of claim 30, wherein said worm gear rotates in a first direction to engage the lock mechanism and rotates in a second direction to disengage the lock mechanism.

34. The lock construction of claim 30, further comprising a first and second stop positioned at opposite ends of the teeth located on said first member, wherein said stops prevent further rotation of the first member and thereby said worm gear.

35. The lock construction of claim 30, further comprising one or more ball bearings disposed within the interior cavity of the lock body to engage the shackle when in a first locked position and disengage from the shackle when in a second unlocked position.

36. The lock construction of claim 35, further comprising a spring member for outwardly biasing said one or more ball bearings away from said first member.

37. The lock construction of claim 30, wherein said number of revolutions for said worm gear is in the range of about 3 to 8 revolutions.

38. A lock construction comprising:

a) a lock body defining an interior cavity;

b) a shackle connected to said lock body and movable to a locked position for securing to an object between said shackle and lock body and an unlocked position for releasing said object secured therebetween;

c) a lock mechanism disposed within the interior cavity, including:

i) a rotatable first member having a toothed section and operatively connected to said shackle for rotation between a first position, to secure said shackle in said locked position in said lock body, and a second position, to release said shackle for movement to said unlocked position, and ii) a rotatable second member disposed adjacent to said first member and having a threaded section configured to intermesh and rotate with said toothed section of said first member;

d) a motor for rotating said second member; and e) a battery connected to said motor, wherein said battery has a voltage in the range of about 3.0 to about 3.6 volts.

39. The lock construction of claim 38, wherein said second member is a worm gear which has a transmission ratio with respect to said first member in the range of about 10 to about 32.

40. The lock construction of claim 38, wherein said motor turns said second member in a first direction to engage the lock mechanism and turns said second member in a second direction to disengage the lock mechanism.

41. The lock construction of claim 38, wherein said first member rotates in the range of about 45° to 120° between said first locked position and said second unlocked position.

* * * * *